United States Patent [19]

Rasmussen

[11] Patent Number: 4,528,973

[45] Date of Patent: Jul. 16, 1985

[54] BOW SIGHT

[76] Inventor: George J. Rasmussen, 7037 W. Kathryn Ave., Milwaukee, Wis. 53218

[21] Appl. No.: 512,556

[22] Filed: Jul. 11, 1983

[51] Int. Cl.[3] ..... F41B 5/00

[52] U.S. Cl. ..... 124/87; 33/265

[58] Field of Search ..... 124/87, 24 R, 23 R, 124/88; 33/265

[56] References Cited

U.S. PATENT DOCUMENTS

| | | | |
|---|---|---|---|
| 4,237,615 | 12/1980 | Bracknell | 33/265 |
| 4,291,469 | 9/1981 | Weast | 124/87 X |
| 4,417,403 | 11/1983 | Strange | 33/265 |

*Primary Examiner*—Richard J. Apley
*Assistant Examiner*—William R. Browne
*Attorney, Agent, or Firm*—James L. Kirschnik

[57] ABSTRACT

A tubular sight for an archery bow is pivotally mounted on a bracket for securing the sight to the handle of an archery bow. A spring loaded locking ball is provided for securing the tubular sight in various predetermined angular positions relative to a horizontal plane for shooting at differing distances. The bracket is also adjustable laterally to permit variations in the horizontal distance between the tubular sight and the bow handle, and the sight may also be adjusted for windage. The spring loaded locking ball engages notches formed in a removable insert to permit simple adjustment of the sight under field conditions.

10 Claims, 10 Drawing Figures

FIG. 1
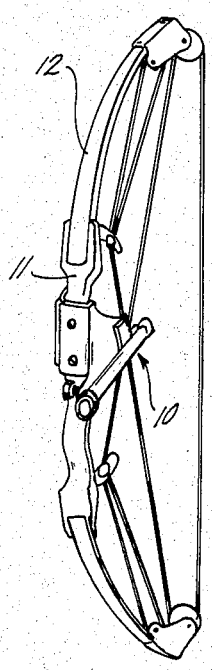
FIG. 2
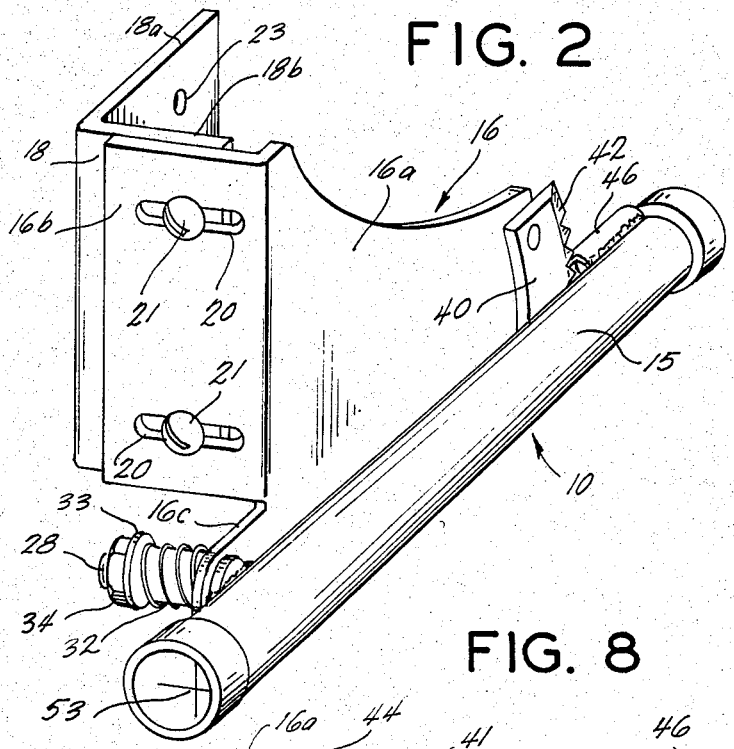
FIG. 8
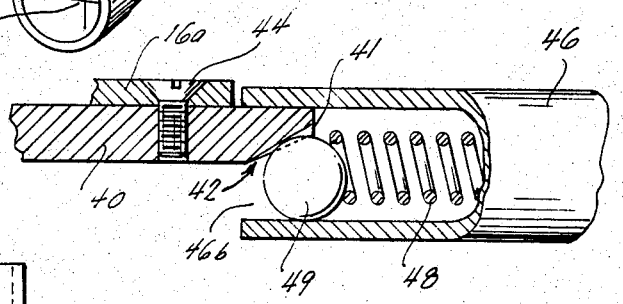
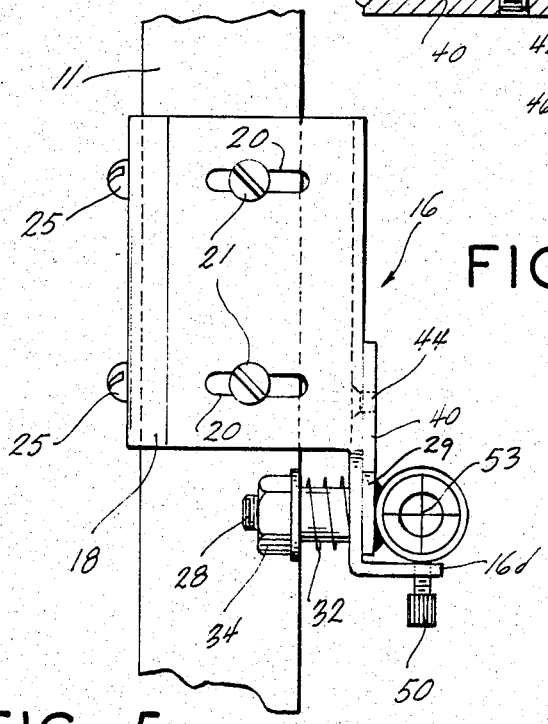
FIG. 5
FIG. 9
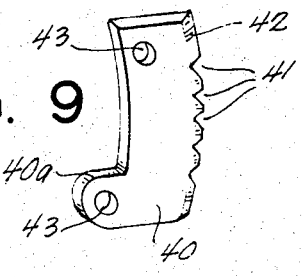
FIG. 10
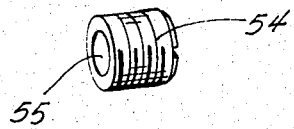

FIG. 4
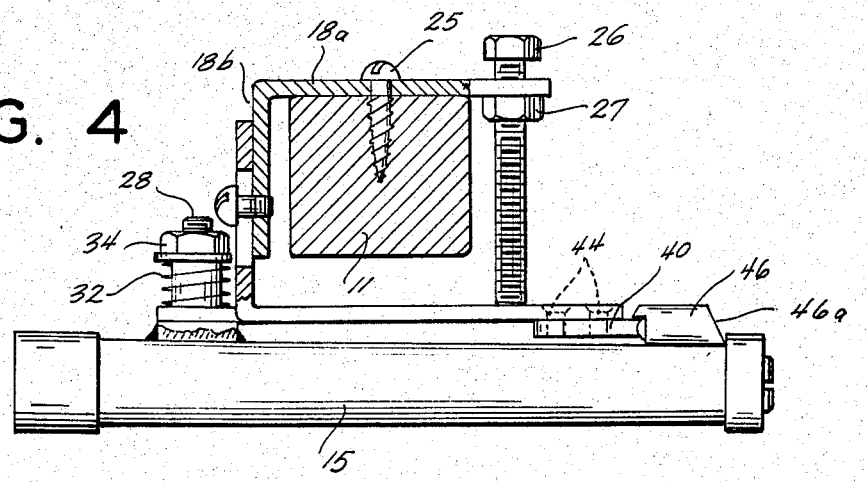
FIG. 6
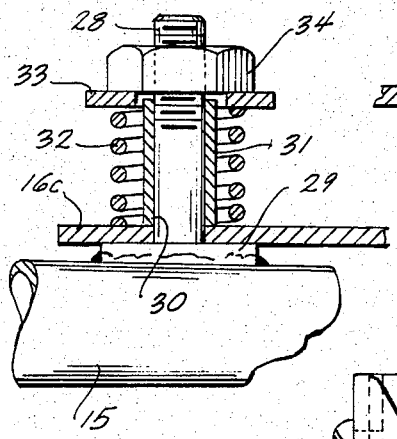
FIG. 7
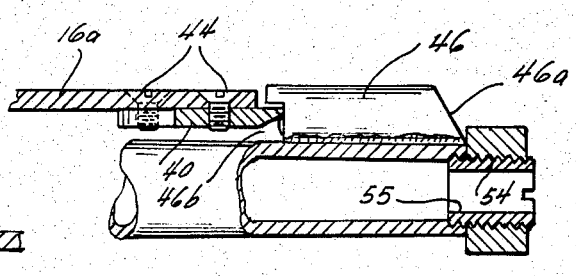
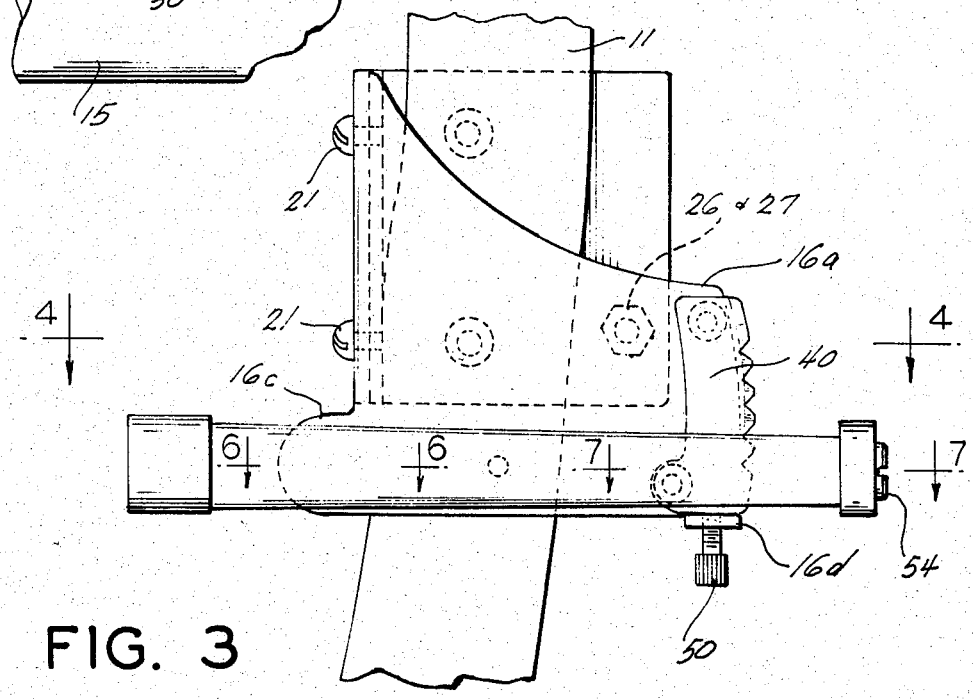
FIG. 3

BOW SIGHT

SUMMARY OF THE INVENTION

The present invention comprises a sight for use with an archery bow. The sight comprises a pivotable elongated tube attached to a bracket mounted on the bow handle. The tubular sight may be pivoted in a vertical plane and retained in predetermined angular orientations for shooting at varying distances. The pivot point of the tube is spring loaded to accommodate shock upon release of an arrow, and a spring loaded locking ball is provided at the rear of the sight for retaining it in the preselected elevation setting. The bracket has means for horizontal adjustment to take into account windage or individual shooter preference.

DESCRIPTION OF THE DRAWINGS

FIG. 1 is a perspective view of a bow having a sight mounted upon it according to the invention.

FIG. 2 is a perspective view of a bow sight according to the invention.

FIG. 3 is a side elevation of the bow sight.

FIG. 4 is a view taken along line 4—4 of FIG. 3.

FIG. 5 is a front elevation view of the bow sight attached to a bow.

FIG. 6 is a view taken along line 6—6 of FIG. 3.

FIG. 7 is a view taken along line 7—7 of FIG. 3.

FIG. 8 is an enlarged section of the rear locking portion of the sight.

FIG. 9 is a perspective view of a locking insert for setting the vertical elevation of the invention; and, FIG. 10 is a perspective view of an aperture insert for the rear of the sight tube.

DESCRIPTION OF A PREFERRED EMBODIMENT

Referring to FIG. 1, the bow sight assembly 10 is shown attached to the handle 11 of a typical compound bow 12. As shown in FIGS. 2 through 5, sight assembly 10 basically comprises a hollow elongated tubular member 15 attached to a first bracket 16 which is in turn slidably mounted on a second bracket 18. The first bracket 16 is generally L-shaped having a first side **16*a* parallel to the axis of the tubular member 15 and a second side 16*b* extending generally perpendicular to the axis of the tube 15 and across the front portion of the bracket 18. Bracket 18 is also basically L-shaped with a first side 18*a* spaced from and parallel to side 16*a* of bracket 16 and having a second side 18*b* adjoining the rear portion of the bracket side 16*b*. Slots 20 are formed in bracket side 16*b* and extend parallel to each other in a generally horizontal orientation. Screws 21 are provided which are threaded into bracket member 18*b* and extend through the slots 20. The screws 21 may be loosened to permit sliding adjustments of brackets 16 and 18 relative to one another, or tightened down to bear upon the bracket surface 16*b* for frictionally securing the bracket members 16 and 18 relative to one another. Holes 23 are provided in the bracket side 18*a* for attaching the bracket to the bow handle 11. The spacing of holes 23 may be such as to coincide with the spacing of typical threaded holes provided in the sides of many bow handles for the mounting of quivers or racks for holding arrows. If no such holes are provided in the bow handle 11 as purchased, they may be formed therein upon installation of bracket 18 and a pair of conventional screws 25 may be provided for attaching the bracket side 18*a* to the bow handle 11**.

Bracket side **18*a* extends beyond and to the rear of handle 11 and a screw 26 is threaded through bracket side 18*a* into contact with bracket side 16 *a*. By tightening screw 26 into contact with bracket 16*a*, the sight assembly may be pivoted to serve as an additional means of adjusting for windage. Once an adjustment is made, a lock nut 27 is tightened against bracket side 18*a* to maintain the position of screw 26**.

Referring to FIGS. 2, 4, 5, and 6, the front portion of tube member 15 is pivotally attached to an extension **16*c* of bracket 16. A threaded pivot screw member 28 has a curved head portion 29 which is attached to the side of tube 15 by any suitable means such as welding or adhesives. The threaded member 28 has its axis extending generally perpendicular to the axis of tube 15 and extends through an aperture 30 formed in the extension 16*c* of bracket 16. Aligned with the aperture 30 is a tubular section 31 attached to the side of extension 16*c* through which the threaded member 28 extends. A compression spring 32 is provided around tube 31 and extends between the side surface of extension 16*c* and a washer 33. A nut 34 may be tightened down on threaded member 28 to push the washer 33 down against compression spring 32. Nut 34 is preferably positioned to place compressive force against spring 32 without contacting the end of tubular member 31. The compression spring 32** thus acts as a shock absorber for forces generated when an arrow is released.

Referring to FIGS. 2, 3, 4, 5, 7, and 8, the rear portion of tubular member 15 engages a locking insert 40 attached to the rear of side **16*a* of bracket 16. Insert 40 is shown removed in FIG. 9 and basically comprises a generally flat arcuate shaped member having serrations or notches 41 formed along its rear convex edge. The rear edge of insert 40 also has a beveled surface 42 through which notches 41 extend. Threaded apertures 43 are provided near the top and along a bottom extension portion 40*a* of insert 40, and screws 44 attach the insert 40 to the rear of the bracket portion 16*a*. The convex rear edge of member 40 is found to match the swing radius of tubular member 15 around the pivot axis of threaded member 28. A small tubular housing 46 is attached to the end of tubular member 15. The tubular member 46 has one end 46*a* closed and the other end 46*b* open and adjacent to and spaced from the rear of insert 40. A compression spring 48 and a ball member 49 are provided within the tube member 46. The ball 49 extends out to open end portion 46*b* under spring force and engages one of the notches 41 at the open end portion 46*b* at the rear of insert 40. Compression spring 48 holds the ball 49 snugly into contact with a preselected notch, but the spring force is such that it may be manually overcome to move the rear end of tube 15 up and down along insert 40 to place the ball 49 into engagement with other preselected notches while pivoting the tube 15 around the threaded pivot point 28. The beveled surface 42 at the rear of the insert 40 acts as a wedge to force ball 49 into snug contact with the opposite inner side of tube 46 as is seen in FIG. 8**.

Beneath the insert 40, a horizontally extending ear portion **16*d* is formed at the rear of bracket side member 16*a* and extends outwardly and beneath the tubular member 15. A screw 50 is threaded through the bottom of the extension 16*d* and may be turned into engagement with the bottom of tubular member 15 to serve as a positive lower stop. The threaded portion and screw 50** also serve another purpose which will be discussed later.

The tubular member 15 is hollow and at the front end, cross hairs 53 may be positioned as shown in FIGS. 2 and 5. At the rear portion, the tube may be open or threaded to receive an insert 54 having a smaller aperture 55 of reduced diameter compared to that of the interior of tube 15. A perspective view of the insert aperture 54 and 55 is shown in FIG. 10.

Having thus described the basic configuration and construction of the invention, its practical application will become readily apparent. The sight assembly 10 is mounted on the handle 11 of the bow such that the tube 15 extends generally parallel to the proposed flight of an arrow. The rear aperture 55 or opening of the tube 15 is placed so as to be generally in alignment with the shooter's eye at the time the bow is drawn back. The shooter thus sights through the tube by looking through the aperture 55 and aligning the cross hairs 53 with a target. Since the actual sighting of a bow is dependent upon many factors, such as the strength of the bow, weight of the arrows used, and individual shooter preferences and idiosyncracies, the sight 10 provides for various adjustments such as the slots 21 in brackets 16 for moving the entire tube assembly laterally. Furthermore, the insert 40 is initially provided with no notches at its rear portion. After the sight assembly 10 is mounted to a bow 12, the screw 50 is used to position the rear elevation of tube member 15 while sighting the bow in at a specified distance. Once consistent results are obtained for a distance of, for example 20 yards, a notch 41 is formed in the rear of the insert 40 by any conventional means such as the use of a file. The archer will then move back to another preselected distance such as 30 or 40 yards. At a greater distance it will be necessary to elevate the bow which is done by raising the rear portion of the sight so that the bow is held at an upward angle in order for the shooter's eye to be aligned with the target. Again, once consistent results are obtained at the next predetermined distance, a new notch 41 will be formed in the insert 40. The same procedure is used to locate notches 41 for various distances.

In practice, the sight has been found to very accurately sight the bow for preselected distances as long as the sight is used on the same bow and with the same weight of arrows. If the sight assembly is to be used on a different bow, it is a simple matter to obtain another blank insert 40 and the sighting in procedure described above repeated. The device is particularly useful in the field when hunting game animals such as deer. If the shooter sees a deer at a certain estimated distance, he can simply move the rear portion of the sight tube 15 to the proper elevation notch 41 and reasonably expect the same consistency of accuracy for that distance. The compression springs 32 and 48 absorb the shock of the bow recoil upon release while still maintaining the sight in its preselected position.

For more precise shooting, the size of the rear aperture 55 is preferably reduced in size. This results in a smaller but more accurate sight alignment with the target. Naturally the rear aperture size may vary to accommodate individual shooter eyesight limitations.

I claim:

1. A sight for an archery bow having a handle portion for gripping the bow, said sight comprising:

(a) elongated sight tube means for sighting along the proposed flight path of an arrow;

(b) bracket means for attaching a sight tube means to the handle of said bow;

(c) first pivot means for pivoting said sight tube means in a generally vertical plane;

(d) locking means for securing said sight tube means in preselected angular positions relative to a horizontal plane;

(e) said locking means comprising a removable insert attached to said bracket means and spaced from said first pivot means and adjacent to said sight tube means, said insert having a plurality of generally vertically spaced notches formed therein; and, (f) means for selectively engaging said sight tube means with one of said plurality of notches by pivoting said sight tube means about said first pivot means.

2. A sight as set forth in claim 1 wherein:

(a) said first pivot means comprises a pivot pin extending between said sight tube means and said bracket means; and (b) spring means interconnecting said pivot pin with said bracket means for providing a resilient connection between said sight tube means and said bracket means.

3. A sight as set forth in claim 1 wherein said selective engaging means comprises spring loaded ball means attached to said sight tube means for engaging said notches and securing said sight tube means in a preselected position.

4. A sight as set forth in claim 1 wherein said bracket means comprises a first portion adapted to be attached to the handle of a bow and a second portion attached to said sight tube means, said first and second portions of said brackets means being movable relative to one another in a direction generally perpendicular to said vertical plane, and means for selectively locking said first and second bracket portions relative to one another.

5. A sight as set forth in claim 4 including means for selectively pivoting said second bracket portion in a plane generally perpendicular to said vertical plane for providing windage adjustments.

6. A sight for an archery bow having a handle portion for gripping the bow, said sight comprising:

(a) elongated sight tube means for sighting along the proposed flight path of an arrow;

(b) bracket means for attaching said sight tube means to the handle of a bow;

(c) first pivot means for pivoting said sight tube means on said bracket means in a first plane generally parallel to the longitudinal axis of a bow, (d) locking means for securing said sight tube means in preselected angular positions within said first plane;

(e) said locking means comprising a plurality of spaced notches formed in said bracket means and engagement means attached to said sight tube means for selectively engaging one of said plurality of notches when said sight tube means is pivoted about said first pivot means.

7. A sight as set forth in claim 6 wherein:

(a) said first pivot means comprises a pivot pin extending between said sight tube means and said bracket means; and (b) spring means interconnecting said pivot pin with said bracket means for providing a resilient connection between said sight tube means and said bracket means.

8. A sight as set forth in claim 6 wherein said engagement means comprises spring loaded ball means attached to said sight tube means for engaging said notches and securing said sight tube means in a preselected position.

9. A sight as set forth in claim 8 including means for selectively pivoting said second bracket portion in a second plane generally perpendicular to said first plane for providing windage adjustments.

10. A sight as set forth in claim 6 wherein said bracket means comprises a first portion adapted to be attached to a bow handle and a second portion attached to said sight tube means, said first and second portions of said bracket means being movable relative to one another in a direction generally perpendicular to said first plane, and means for selectively locking said first and second bracket portions relative to one an other.

* * * * *